US007204071B1

(12) United States Patent
Walker et al.

(10) Patent No.: US 7,204,071 B1
(45) Date of Patent: Apr. 17, 2007

(54) PROTECTIVE FACEMASK FOR HORSES

(76) Inventors: Robin Vanessa Walker, 19123 E. Via De Arboles, Queen Creek, AZ (US) 85242; Jamie Denise Amborn, 18823 Via Del Oro, Queen Creek, AZ (US) 85242

( * ) Notice: Subject to any disclaimer, the term of this patent is extended or adjusted under 35 U.S.C. 154(b) by 5 days.

(21) Appl. No.: 10/994,865

(22) Filed: Nov. 22, 2004

Related U.S. Application Data

(60) Provisional application No. 60/524,447, filed on Nov. 24, 2003.

(51) Int. Cl.
*B68C 5/00* (2006.01)

(52) U.S. Cl. ..... 54/80.5; 54/80.2

(58) Field of Classification Search ..... 54/80.5, 54/80.2, 80.3; 119/856
See application file for complete search history.

(56) References Cited

U.S. PATENT DOCUMENTS

| | | | | |
|---|---|---|---|---|
| 4,404,789 | A | 9/1983 | Denning | |
| 4,581,877 | A | 4/1986 | Wilber | |
| 4,662,156 | A | 5/1987 | Oettel | |
| 5,345,751 | A | 9/1994 | Edwards | |
| 5,440,864 | A * | 8/1995 | Green | 54/80.5 |
| 6,050,068 | A | 4/2000 | White, Jr. | |
| 6,128,891 | A | 10/2000 | McMahon | |
| D459,556 | S | 6/2002 | Martin | |
| 6,397,783 | B1 * | 6/2002 | Koch | 119/856 |
| 6,574,948 | B2 | 6/2003 | Longtin | |
| 2002/0108586 | A1 | 8/2002 | Martin | |
| 2004/0159083 | A1 * | 8/2004 | Andrews | 54/80.5 |

* cited by examiner

*Primary Examiner*—Teri Pham Luu
*Assistant Examiner*—Elizabeth Shaw
(74) *Attorney, Agent, or Firm*—John D. Lister

(57) ABSTRACT

A protective facemask for horses includes a panel of an open mesh material and an elastic headstall and an elastic throatlatch that are without fasteners. When the facemask is worn, an upper edge portion of the panel passes around a horse's forehead below the forelock and above the eyes and a lower edge portion of the panel passes over an upper region of a horse's muzzle forward of a horse's eyes and from this region to adjacent a throatlatch region of a horse's throat. When the facemask is worn, the headstall passes over the poll region of a horse's head and the throatlatch extends from the ends of the headstall under a throatlatch region of a horse's throat.

2 Claims, 3 Drawing Sheets

FIG. 4
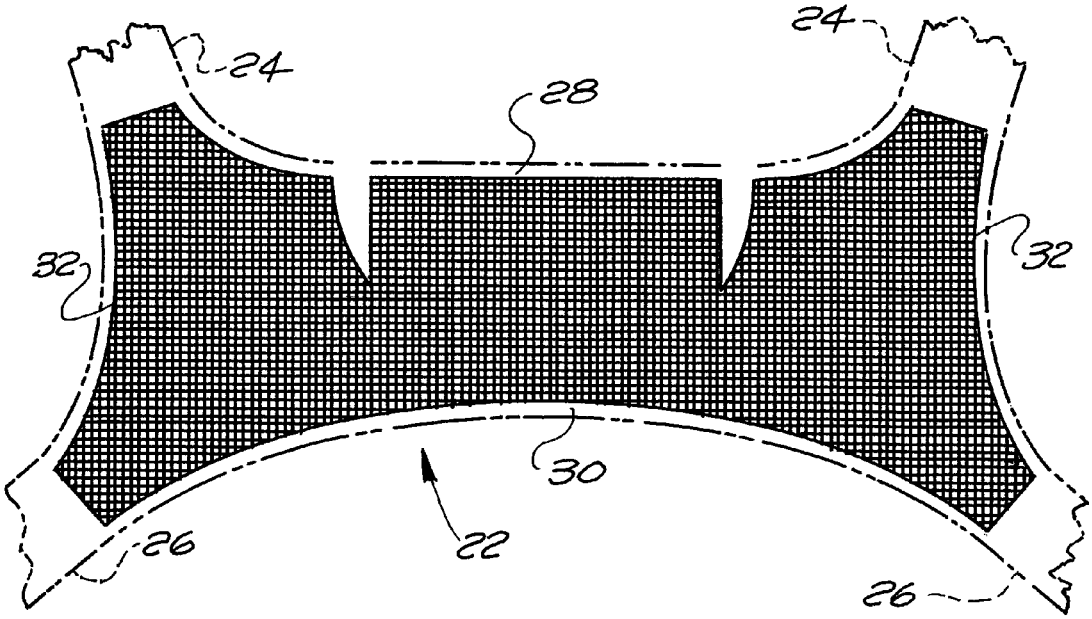
FIG. 5
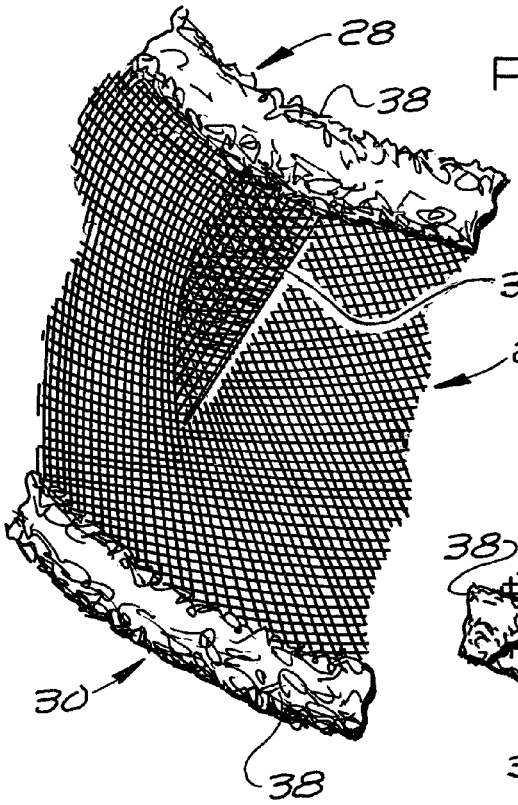
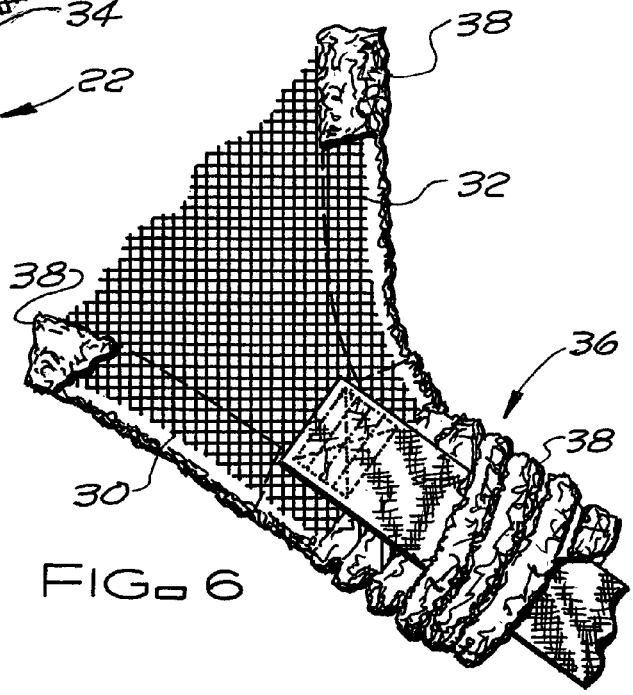
FIG. 6

PROTECTIVE FACEMASK FOR HORSES

This patent application claims priority to provisional patent application No. 60/524,447, filed Nov. 24, 2003, the disclosure of which is hereby incorporated herein by reference.

BACKGROUND OF THE INVENTION

The subject invention relates to protective facemask for horses, which includes a panel of an open mesh material and an elastic headstall and an elastic throatlatch. The elastic headstall and elastic throatlatch of the protective facemask of the subject invention do not include any fasteners that must be actuated to secure the protective facemask to a horse or remove the protective facemask from a horse. The protective facemask of the subject invention: is protective of the horse's face, is very easy to put on and take off a horse with very little disturbance of the horse, stays securely on the horse's head when being worn, has a tear away feature to free a horse should the facemask become caught on something, is decorative and distinctive, is durable, and is relatively inexpensive to produce.

Current protective facemasks typically use fasteners, such as Velcro® fasteners, that must be actuated (opened and/or closed) to secure the facemasks to or remove the facemasks from a horse's head or to secure the facemasks to or detach the facemasks from separate halters or bridles that retain the facemasks on a horse's head. When Velcro® fasteners and other fasteners such as snaps, buttons, hooks, etc. are used to secure these facemasks to a horse's head, the horses can rub these fasteners against fence posts and other objects which loosen or actuate the fasteners and permit the facemasks to fall off. When using Velcro® fastener(s) on a facemask, it is very easy for a horse to remove such a facemask from another horse by simply grabbing a Velcro® fastener of the facemask in its teeth and pulling the facemask off. Additionally, Velcro® fasteners can become contaminated or clogged with debris which greatly reduces their effectiveness as a fastener. Thus, there has continued to be need for a protective facemask for a horse that is very easy to put on and take off a horse without disturbing the horse, stays securely on the horse's head when being worn, has a tear away feature to free a horse should the facemask become caught on something, is decorative and distinctive, is durable, and is relatively inexpensive to produce. The protective facemask of the subject invention, which uses an elastic headstall and an elastic throatlatch without fasteners, fulfills the need to provide such an improved protective facemask.

SUMMARY OF THE INVENTION

The protective facemask for horses of the subject invention includes a panel made of an open mesh material, an elastic headstall that passes over the poll region of a horse's head adjacent and behind the horse's ears, and an elastic throatlatch that extends from the ends of the headstall under the throatlatch region of a horse's throat.

When the protective facemask of the subject invention is worn, an upper edge portion of the panel passes around a horse's forehead below the forelock and above the eyes and a lower edge portion of the panel passes over an upper region of a horse's muzzle forward of a horse's eyes and from this region to adjacent a throatlatch region of a horse's throat. Preferably, the open mesh material of the protective facemask panel includes darts over the horse's eye region to space the open mesh material of the panel outward from the horse's eyelids and eyelashes.

The elastic headstall of the protective facemask of the subject invention extends between junctures of the upper edge portion and lateral throatlatch edge portions of the panel. When the protective facemask is worn, the elastic headstall passes over the poll region of a horse's head. The elastic headstall has an elastic section or is elastic throughout its length. When the protective facemask is placed over a horse's head, the elastic headstall typically expands in length to facilitate the placement and then shortens from the expanded length to engage and grip the poll region of a horse's head.

The elastic throatlatch of the protective facemask of the subject invention extends from the ends of the elastic headstall under a throatlatch region of a horse's throat. The elastic throatlatch includes lateral throatlatch edge portions of the panel and an elastic portion that extends between junctures of the lower edge and lateral throatlatch edge portions of the panel. The elastic portion of the throatlatch can have an elastic section or be elastic throughout its length. When the protective facemask is worn, the elastic portion of the throatlatch passes under the throatlatch region of a horse's throat. When the protective facemask is placed over a horse's head, the elastic portion of the throatlatch typically expands in length to facilitate the placement and then shortens from the expanded length to engage and grip the throatlatch region of a horse's throat while the facemask is worn.

Due to the unique design of the protective facemask of the subject invention, the protective facemask of the subject invention is easily and quickly placed on a horse's head, with very little disturbance of the horse, simply by placing the horse's muzzle into the facemask and pulling the elastic headstall up, over, and behind the horse's ears. The elasticity of the headstall and the throatlatch make it easy to pass the elastic headstall up, over and behind the horse's ears and secure the protective facemask to the horse's head with the rear of the horse's jaw helping to maintain the elastic throatlatch of the protective facemask in place under the horse's throat while the protective facemask is being worn. The protective facemask of the subject invention can also be easily removed from a horse's head, with very little disturbance of the horse, simply by lifting the elastic headstall up and over the horse's ears and pulling the facemask forward off of the horse's muzzle. In addition, to providing a protective facemask that is easy and quick to place on or remove from a horse's head, the elasticity of the headstall and the throatlatch of the protective facemask of the subject invention eliminates the need for closures such as Velcro® fasteners, snaps, button, hooks, etc. that are commonly used on facemasks. Thus, the protective facemask of the subject invention both reduces the cost of the protective facemask and eliminates a task that must be performed when using facemasks equipped with fasteners.

Preferably, the edge portions of the panel, the elastic headstall, and the elastic throatlatch of the protective facemask of the subject invention are all encased in soft fabrics or materials, such as but not limited to faux-fur with animal or other prints or designs, fleece, and various other soft fabrics or materials that may have decorative patterns or designs. These soft fabrics or materials help prevent the protective facemask of the subject invention from causing skin irritation and help keep insects from passing under the edge portions of the panel to get within the protective facemask.

Should the protective facemask become caught on something, the protective facemask is designed to tear apart at one or both of the junctures of the elastic headstall with the top edge portion and the throatlatch edge portions of the panel and/or at one or both of the junctures of the elastic portion of the throatlatch with the lower edge portion and the throatlatch edge portions of the panel to free the horse.

BRIEF DESCRIPTION OF THE DRAWINGS

FIG. 4 is plan view of the open mesh material pattern used to make the open mesh panel of the protective facemask of the subject invention.

FIG. 5 is a detail, on a larger scale than FIG. 4, of a dart of the open mesh panel of the facemask of the subject invention.

FIG. 6 is a detail, on a larger scale than FIG. 4 and with portions broken away, to show an end of the elastic portion of the throatlatch sewn to the panel of the facemask of the subject invention. While this Figure illustrates the manner in which one end of the elastic portion of the throatlatch is secured to the panel of the facemask, this figure is representative of the preferred method of securing the ends of the elastic headstall as well as the ends of the elastic portion of the throatlatch to the panel of the facemask.

DESCRIPTION OF THE PREFERRED EMBODIMENTS

Figure 1:
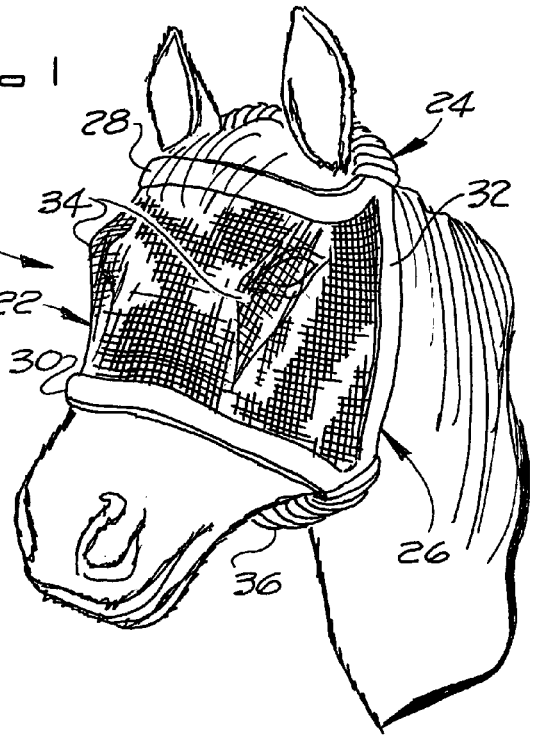
FIG. 1 is a perspective view of a horse's head with the protective facemask of the subject invention being worn by the horse.

As shown in FIGS. 1 to 3, 7 and 8, the protective facemask 20 for horses of the subject invention includes a panel 22 made of an open mesh material, an elastic headstall 24 that passes over the poll region of a horse's head adjacent and behind the horse's ears, and an elastic throatlatch 26 that extends from the ends of the elastic headstall under the throatlatch region of a horse's throat.

As shown in FIG. 4, the panel 22 has an upper edge portion 28, a lower edge portion 30, and lateral throatlatch edge portions 32. When the protective facemask 20 is worn, the upper edge portion 28 of the panel 22 passes around a horse's forehead below the forelock and above the eyes and the lower edge portion 30 of the panel 22 passes over an upper region of a horse's muzzle forward of a horse's eyes and from this region to adjacent a throatlatch region of a horse's throat. The mesh size of the open mesh material of the panel 22 permits a horse to have relatively good vision while at the same time protecting a stabled, pastured, or transported horse's face from insects, blowing debris, blowing dirt, and other foreign objects. Preferably, the open mesh material of the protective facemask panel 22 is inelastic so that the panel 22 will not stretch or expand and lose its shape and includes darts 34, such as the dart shown in FIG. 5, over the horse's eye region to space the open mesh material of the panel 22 outward from the horse's eyelids and eyelashes.

The elastic headstall 24 of the protective facemask 20 extends between junctures of the upper edge portion 28 and lateral throatlatch edge portions 32 of the panel 22. When the protective facemask 20 is worn, the elastic headstall 24 passes over the poll region of a horse's head. The elastic headstall 24 has an elastic section or is elastic throughout its length. When the protective facemask 20 is placed over a horse's head, the elastic headstall can be expanded in length to facilitate the placement and then will shorten from the expanded length to engage and grip the poll region of a horse's head. The elastic headstall 24 does not have any fasteners that must be actuated (e.g. opened and/or closed) to place the protective facemask 20 on or remove the protective facemask from a horse's head.

Figure 2A:
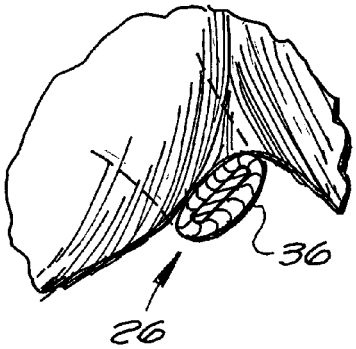
FIG. 2A is a detail in cross section of the circled portion of FIG. 2, on a larger scale than FIG. 2, to better show the elastic portion of the throatlatch of the protective facemask of the subject invention passing beneath the throatlatch region of a horse's throat.
Figure 2:
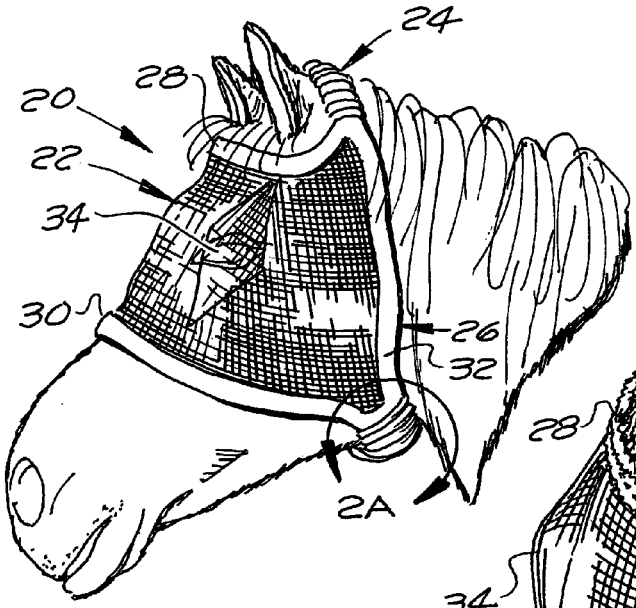
FIG. 2 is a side view of the horse's head of FIG. 1 with the protective facemask of the subject invention being worn by the horse.
Figure 3:
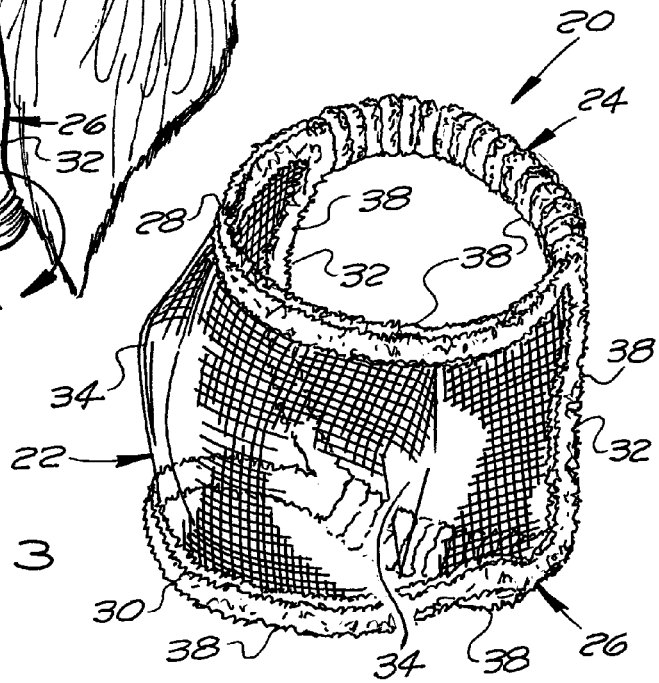
FIG. 3 is a perspective view of the protective facemask of the subject invention.
Figure 7:
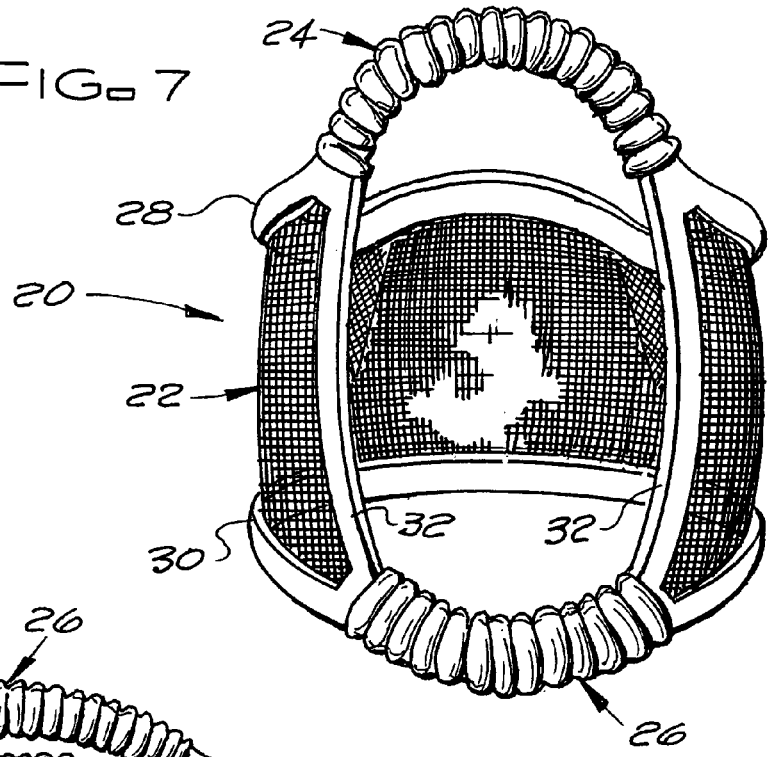
FIG. 7 is a top view of the protective facemask of the subject invention.
Figure 8:
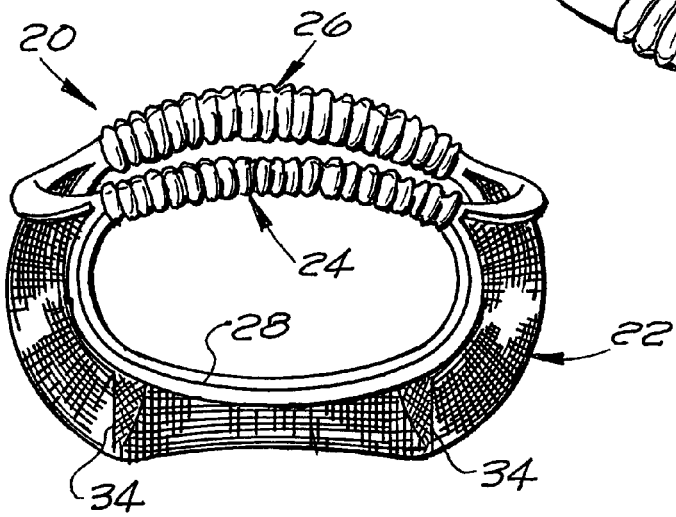
FIG. 8 is a rear view of the protective facemask of the subject invention.

The elastic throatlatch 26 of the protective facemask 20 extends from the ends of the elastic headstall 24 under a throatlatch region of a horse's throat. The elastic throatlatch 26 includes lateral throatlatch edge portions 32 of the panel 22 and an elastic portion 36 that extends between junctures of the lower edge portion 30 and lateral throatlatch edge portions 32 of the panel 22. The elastic portion 36 of the elastic throatlatch 26 has an elastic section or is elastic throughout its length. When the protective facemask 20 is worn, the elastic portion 36 of the elastic throatlatch 26 passes under the throatlatch region of a horse's throat as shown in FIG. 2A. When the protective facemask 20 is placed over a horse's head, the elastic portion 36 of the elastic throatlatch can be expanded in length to facilitate the placement and then will shorten from the expanded length to engage and grip the throatlatch region of a horse's throat while the facemask is worn. The elastic throatlatch 26 does not have any fasteners that must be actuated (e.g. opened and/or closed) to place the protective facemask 20 on or remove the protective facemask from a horse's head.

Figure 9:
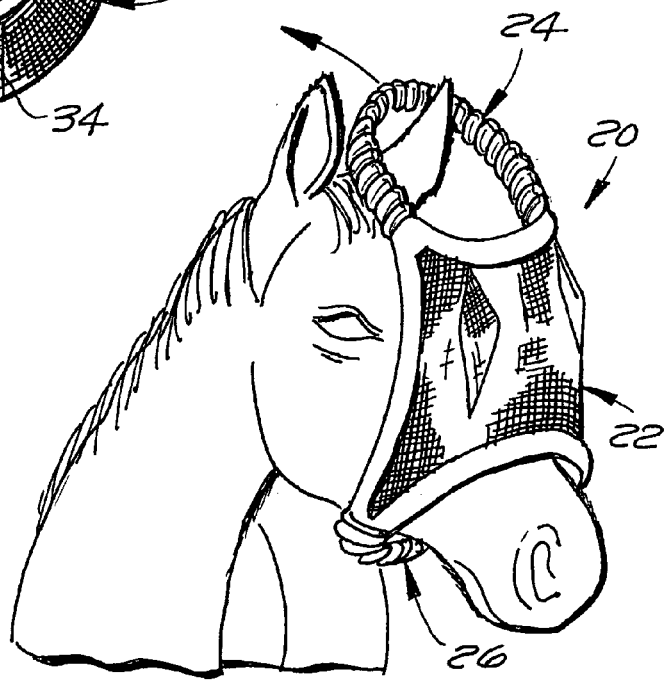
FIG. 9 shows the protective facemask of the subject invention in the process of being placed over a horse's head.

As shown in FIG. 9, due to the unique design of the protective facemask 20, the protective facemask 20 is easily and quickly placed on a horse's head, with very little disturbance of the horse, simply by placing the horse's muzzle into the protective facemask 20 and pulling the headstall 24 up, over, and behind the horse's ears. The elasticity of the headstall 24 and the throatlatch 26 make it easy to pass the headstall 24 up, over and behind the horse's ears to secure the protective facemask 20 to the horse's head with the rear of the horse's jaw helping to maintain the elastic portion 36 of the throatlatch 26 of the protective facemask in place under the horse's throat while the facemask is being worn. The protective facemask 20 can also be easily removed from a horse's head, with very little disturbance of the horse, simply by lifting the elastic headstall 24 up and over the horse's ears and pulling the protective facemask 20 forward off of the horse's muzzle. As discussed above, in addition, to providing a protective facemask 20 that is easy and quick to place on or remove from a horse's head, the elasticity of the headstall 24 and the throatlatch 26 of the protective facemask 20 eliminates the need for closures such as but not limited to Velro® fasteners, snaps, button, hooks, etc. that are commonly used on facemasks to secure the facemasks to a horse's head.

Preferably, the edge portions of the panel 28, 30 and 32; the elastic headstall 24, and the elastic throatlatch 26 of the protective facemask 20 are all encased in soft fabrics or materials 38, such as but not limited to faux-fur with animal prints, fleece, and various other soft fabrics or materials that may have decorative patterns or designs thereon. The elastic sections of the headstall 24 and the throatlatch 26 are encased within soft fabric or materials that are gathered to permit the expansion and contraction of these sections. These soft fabrics or materials help prevent the edge portions of the panel 22 from causing skin irritation and help keep insects from passing under the edge portions of the panel 20 to get within the protective facemask 20 and help prevent the elastic headstall 24 and the elastic throatlatch 26 from causing skin irritation. Thus, these soft fabrics or materials are not only protective of the horse, but are decorative, distinctive, and make the protective facemasks 20 stand out relative to other facemasks.

Preferably, the elastic headstall 24 and the elastic portion 36 of the elastic throatlatch 26 are secured to the panel 22 of the protective facemask 20 so that the elastic headstall 24 and the elastic portion 36 of the elastic throatlatch 26 will not separate from the panel 22 under normal usage, but will separate from the panel 22 when placed under sufficient stress by a horse, such as when the protective facemask being worn by a horse becomes caught on an object. Preferably, the headstall 24 and the elastic portion 36 of the throatlatch 26 are sewn to the panel 22, as shown in FIG. 6, with stitches that, should the protective facemask 20 become caught on an object, can be torn apart by a horse pulling away from the object. The use of an elastic headstall 24 and the elastic throatlatch 26 on the protective facemask 20 to secure the protective facemask to a horse's head make it much more difficult for a horse to accidentally remove the protective facemask 20. Yet, with its separable form of attachment, should the protective facemask 20 become caught on something, the protective facemask 20 will tear apart (e.g. the stitches will tear apart) at one or both of the junctures of the elastic headstall 24 with the top edge portion 28 and the throatlatch edge portions 32 of the panel 20 and/or one or both of the junctures of the elastic portion 36 of the elastic throatlatch 26 with the lower edge portion 30 and the throatlatch edge portions 32 of the panel 20 to free the horse.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A protective facemask for horses comprising:

a panel of an open mesh material; the panel having an upper edge portion, a lower edge portion, and lateral throatlatch edge portions; the upper edge portion of the panel passing around a horse's forehead below the forelock and above the eyes of a horse when the facemask is worn; the lower edge portion of the panel passing over the upper region of a horse's muzzle at a location forward of a horse's eyes and from this upper region of a horse's muzzle to adjacent a throatlatch region of a horse's throat when the facemask is worn; the panel of open mesh material being the only panel of open mesh material, having no horizontal seams, of the protective facemask and including vertical diamond shaped darts over an eye region of the facemask to space the panel outward from a horses eyelids and eyelashes;

an elastic headstall for passing over the poll region of a horse's head adjacent and behind the horse's ears when the facemask is worn; the elastic headstall being without fasteners; the elastic headstall extending between and having first and second ends that are secured to the panel at junctures of the upper edge portion of the panel and the lateral throatlatch edge portions of the panel;

an elastic throatlatch for extending from the ends of the elastic headstall under a throatlatch region of a horse's throat when the facemask is worn; the elastic throatlatch being without fasteners; the elastic throatlatch including the throatlatch edge portions of the panel and an elastic throatlatch portion; the elastic throatlatch portion of the elastic throatlatch passing under the throatlatch region of a horse's throat when the facemask is worn and extending between and having first and second ends that are secured to the panel at junctures of the lower edge portion of the panel and the lateral throatlatch edge portions of the panel that, when the facemask is worm, are located adjacent the underside and rear portion of a horses lower jaw;

the ends of the elastic headstall being sewn to the panel, at the junctures of the top edge portion and the lateral throatlatch edge portions of the panel, with stitches that are adapted to tear apart under stress so that the facemask separates from a horse should the facemask become caught on something; and the ends of the elastic throatlatch portion of the throatlatch being sewn to the panel, at the junctures of the bottom edge portion and the lateral throatlatch edge portions of the panel, with stitches that are adapted to tear apart under stress so that the facemask separates from a horse should the facemask become caught on something.

2. The protective facemask for horses according to claim 1, wherein:

the top edge portion, the bottom edge portion, and the lateral throatlatch edge portions of the panel are encased within a soft and decorative material to help keep the facemask from causing skin irritation and to keep insects from passing under the edge portions of the panel to get within the facemask; and the elastic headstall and the elastic portion of the throatlatch are encased in a soft and decorative material to help keep the facemask form causing skin irritation.

* * * * *